US006170638B1

(12) United States Patent
Davenport

(10) Patent No.: US 6,170,638 B1
(45) Date of Patent: Jan. 9, 2001

(54) STREAM ALIGNER

(75) Inventor: Gary Davenport, Sellersville, PA (US)

(73) Assignee: Graphic Management Associates, Inc., Bethlehem, PA (US)

( * ) Notice: Under 35 U.S.C. 154(b), the term of this patent shall be extended for 0 days.

(21) Appl. No.: 09/307,381

(22) Filed: May 7, 1999

(51) Int. Cl.[7] ..... B65G 47/26
(52) U.S. Cl. ..... 198/456; 271/240; 198/803.13
(58) Field of Search ..... 198/456, 803.13, 198/803.5; 271/240

(56) References Cited

U.S. PATENT DOCUMENTS 4,058,202 * 11/1977 Reist et al. ..... 198/456
4,667,809 * 5/1987 Raybuck ..... 198/456
4,723,770 * 2/1988 Seidel et al. ..... 198/803.5
4,824,307 * 4/1989 Johnson et al. ..... 198/456
5,823,320 * 10/1998 Seidel et al. ..... 198/803.5

* cited by examiner

*Primary Examiner*—Jospeh E. Valenza
(74) *Attorney, Agent, or Firm*—Jordan B. Bierman; Bierman, Muserlian and Lucas

(57) ABSTRACT

A conveyor which includes one or more pocket assemblies which are adapted to be transported in a closed path. The assembly includes a pocket having two walls which are hinged to each other. In the closed position, the walls retain the product (newspaper) between them and, in their open position, they are spaced apart and can receive the product inserted therein. There is a pair of aligners mounted on the pocket which move from a retracted position to a forward position. If the product is misaligned in either direction transverse to the path of the pocket, one of the other of the aligners will contact the nearest edge of the product and push it into a central position in the pocket.

5 Claims, 2 Drawing Sheets

STREAM ALIGNER

This Application is directed to a device which aligns products being carried in a movable pocket; more particularly, it finds use in devices for receiving and transporting newspapers.

BACKGROUND OF THE INVENTION

The Invention will be described specifically with relation to the transportation of newspapers in pocket conveyors, but it is understood that it is not intended to be limited thereto. Conveyors comprising a plurality of pockets arranged serially have long been known. The pockets consist of two walls, usually hinged together at or adjacent their lower ends. The pockets have an open position, wherein a newspaper can be introduced therein, and a closed position, where the walls are adjacent each other and the newspaper is held therebetween. Commonly, each pocket receives a newspaper jacket, closes, and then reopens with a vacuum applied to the jacket. This causes the jacket to open for reception of one or more inserts.

As these devices are fed mechanically at high speed, it is not unusual for the newspapers to be off center in the pockets. As a result, a gripper picking up the newspaper from the pocket will not hold it in the center. Therefore, it will be unbalanced, thereby increasing the probability that it will be dropped. When this occurs, there is a substantial risk that the jacket will not be fully opened. Therefore, when the insert is fed into the pocket, it will at least partially damage the jacket so that the paper will have to be discarded. Should the malfunction be sufficient so that the jacket does not open at all, then the insert will fall into the pocket outside the jacket. Here, too, the paper will have to be discarded. In addition to the foregoing, misaligned newspapers can cause jamming of the entire machine, thereby requiring that it be stopped and cleared before production can continue.

When a standard sized newspaper is being handled, a pair of endless belts (one on each edge) is adjusted to bear against the side edges of the newspaper, thereby centering it within the pocket. However, when the newspapers are small, it is necessary to elevate them from the hinge so that they project into the cut-out in the pocket walls. This enables the gripper to grasp the paper and remove it from the pocket. If this is done, however, the endless belts are beneath the folded edge of the paper and therefore cannot be used for alignment.

SUMMARY OF THE INVENTION

The present Invention is intended to remedy the foregoing shortcomings of the prior art. Specifically, it is an object of the present Invention to center each newspaper in its respective pocket so that, when it is picked up by a gripper, the latter holds it midway between its sides.

A conveyor is provided for at least one pocket assembly which is adapted to be transported in a closed path. The assembly comprises a pocket having a first wall and a second wall hinged to the first wall. At least one of the walls is movable toward the other between a closed position, where the walls are adjacent each other, and an open position, where the walls are separated for receipt of the newspaper.

A first aligner is located adjacent the near side of the pocket and has a retracted position, wherein it is out of contact with the newspaper, and a forward position, spaced apart from the retracted position in a transverse direction toward the far side. When moving from its retracted position to its forward position, the first aligner bears against the near side of a newspaper located closer to the near side than the far side, and thereby centers it by moving it toward the far side.

A second aligner, substantially the same as the first aligner, is located adjacent the far side of the pocket. The second aligner operates in the same manner as the first aligner, except that it contacts the far side of the newspaper when it is off benter toward the far side and urges it toward the near side when moving into its forward position. As a result of the action of both aligners, the newspapers are centered within the pocket, regardless of whether they were misaligned toward the near side or toward the far side. Preferably, both aligners move inward into their forward positions simultaneously.

BRIEF DESCRIPTION OF THE DRAWINGS

In the accompanying drawings, constituting a part hereof, and in which like reference characters indicate like parts.

DETAILED DESCRIPTION OF THE INVENTION

Figure 2:
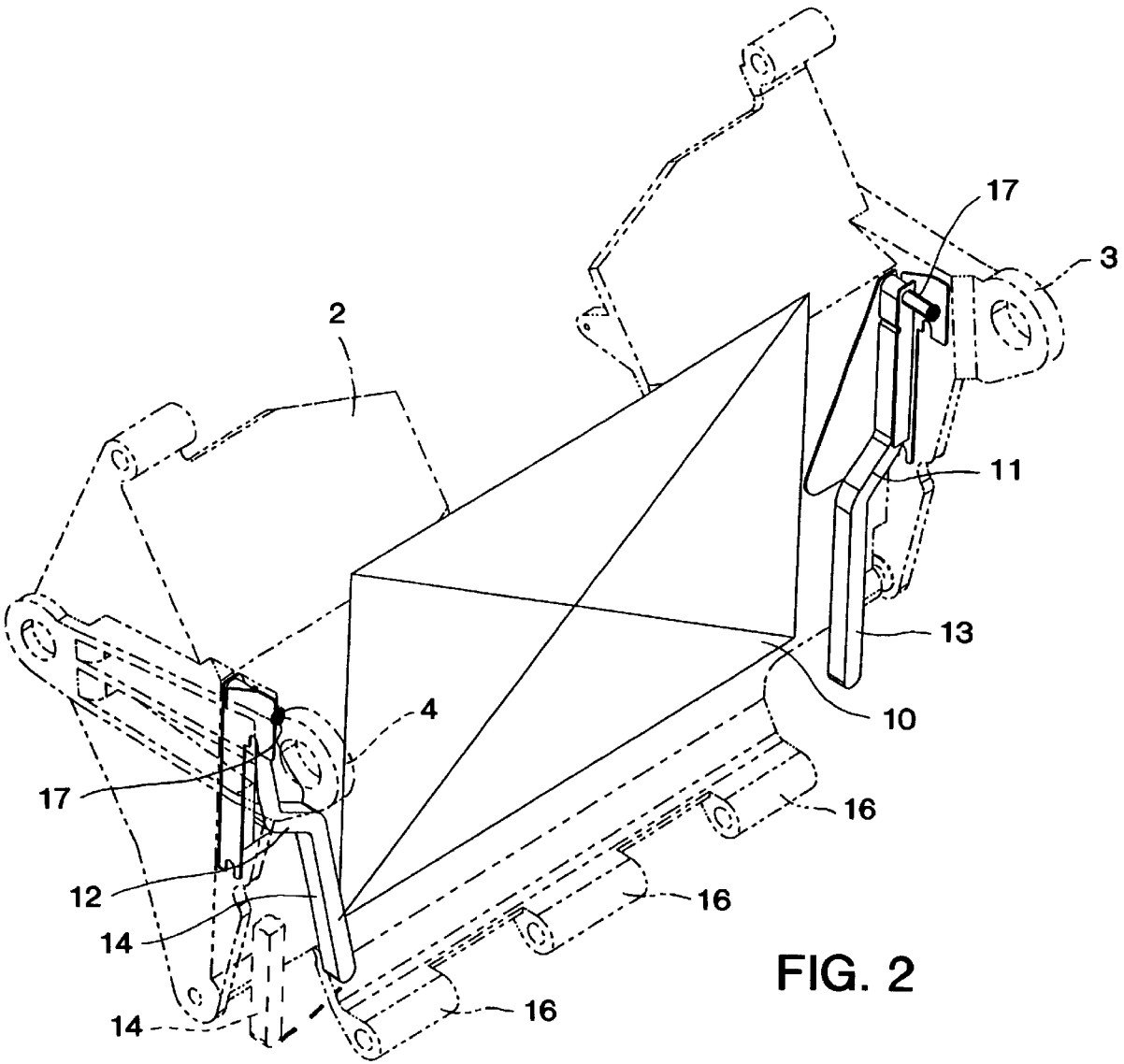
FIG. 2 is a view, similar to that of FIG. 1, showing a product in the pocket.

Pocket assembly 1 comprises fixed pocket wall 2 and a movable pocket wall (not shown) and pivots about hinge 16. The pocket is suspended from far support 3 and near support 4. Belt 5, which passes around sprockets or pulleys 6 and 8, is driven by the pockets and sprocket 7 provides the desired tension in belt 5 and presses the belt inwardly. Product 10 is located in the pocket as shown in FIG. 2.

If the dimension of product 10 from the lower edge to the upper edge is shorter than normal, pocket insert 9 is placed in the pocket. This serves to raise product 10 so that it will project into the cut-out portion of fixed pocket wall 2 and the movable wall. This permits the gripper to take hold of the paper and remove it from the pocket as needed.

Figure 1:
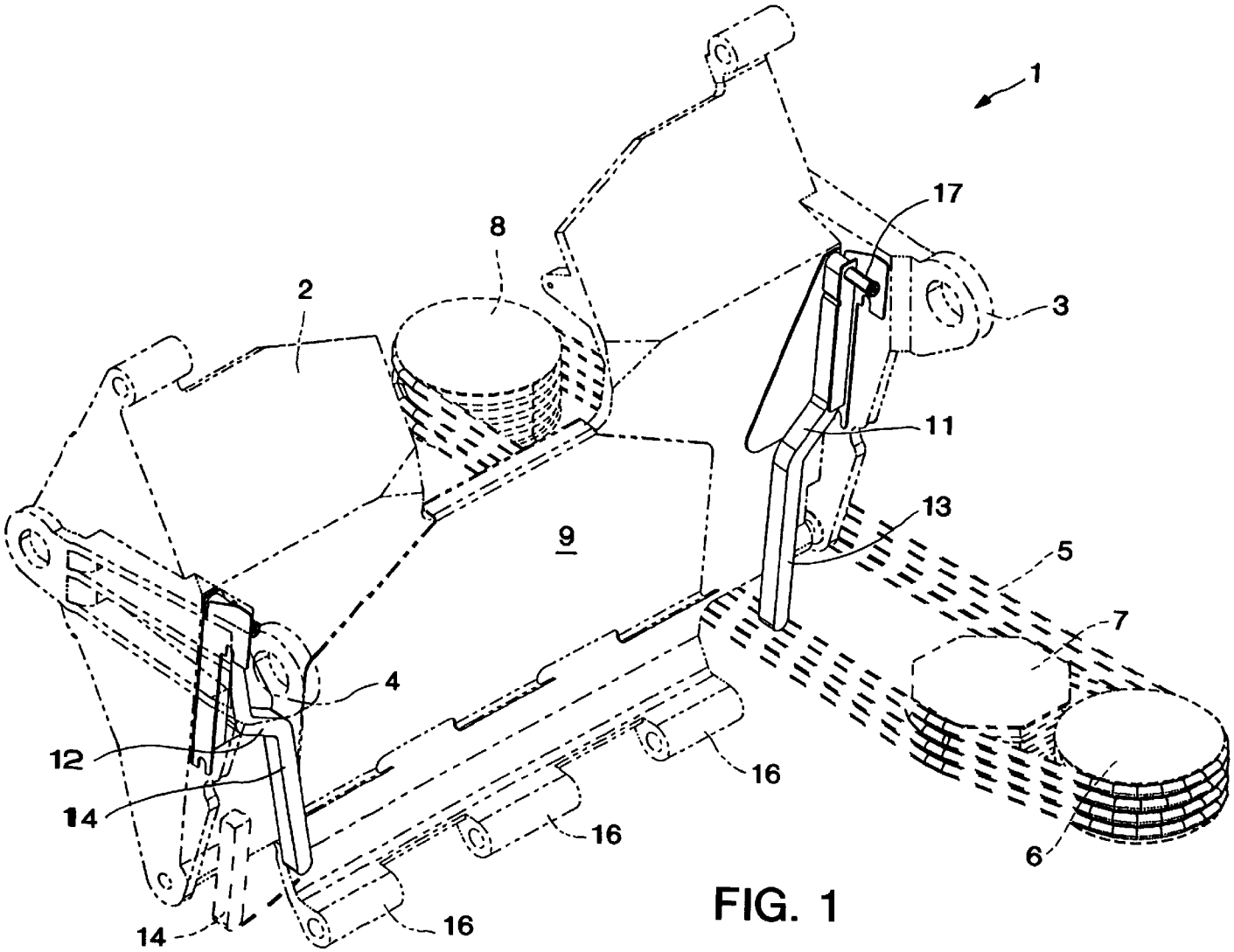
FIG. 1 is a schematic perspective view, partially broken away, of a pocket assembly according to the Invention.

First aligner 11 and second aligner 12 are mounted on the pocket and include first aligner bar 13 and second aligner bar 14. The retracted position of second aligner bar 14 is shown in broken lines (see FIG. 1). Since aligner bars 13 and 14 extend downwardly, belt 5 can contact them and cause them to move inwardly. Aligners 11 and 12 pivot about pin 17 and a coil spring (not shown) urges aligners 11 and 12 outwardly toward their retracted positions.

In a preferred form of the Invention, belt 5 is adjustable by moving sprocket or pulley 8 toward the pocket so that the belt pivots about sprocket or pulley 6. As a result, belt 5 angles inwardly in the direction of travel of the pockets. The inner flight of belt 5 bears against aligner bar 13, thereby actuating it. Aligner 12 and aligner bar 14 are similarly actuated, although the other belt 5 is omitted for clarity.

Thus, if product 10 is closer to the near side than the far side (as shown in FIG. 2), movement of aligner bar 14 from its retracted position (broken lines) to its forward position (solid lines) causes it to contact the near edge of product 10 and urge it toward a point midway between the sides of the pocket. On the other hand, if product 10 is closer to the far side than the near side, movement of aligner 11 will cause aligner bar 13 to bear against the far side of product 10 and urge it toward the center of the pocket. In operation, both first and second aligners 11 and 12 are actuated simultaneously so that aligner bars 13 and 14 will move product 10 to the center of the pocket, regardless of the direction in which it is misaligned.

Although only a limited number of specific embodiments of the present Invention have been expressly disclosed, it is, nonetheless, to be broadly construed and not to be limited except by the character of the claims appended hereto.

What is claimed is:

1. A conveyor including at least one openable and closable pocket assembly adapted for transportation in a closed path in a downstream direction, said assembly comprising a pocket having a first wall and a second wall, said first wall being pivotable about a hinge toward said second wall into a closed position and pivotable about said hinge away from said second wall into an open position, cut-outs in said first wall and said second wall extending toward said hinge from remote edges thereof spaced apart from and parallel to said hinge, said cut-out terminating in a bottom edge spaced apart from said hinge by a height, said cut-out adapted to permit grippers to pass therethrough to grasp a thin flexible product in said pocket, said product having a lower edge, parallel to said hinge, and an upper edge, remote from said hinge and parallel thereto, said pocket having a near side and a far side, said far side being remote from said near side in a transverse direction to said path, said lower edge being spaced apart from said hinge, thereby defining a gap, a pair of endless belts, one adjacent said near side and another adjacent said far side, one flight of each of said endless belts being in said gap, said lower edge being spaced apart from said hinge, thereby defining a gap, a first aligner adjacent said near side and having a retracted position, wherein said first aligner is out of contact with said product, and a forward position spaced apart from said retracted position in said transverse direction toward said far side, a second aligner adjacent said far side and having a retracted position, wherein said second aligner is out of contact with said product, and a forward position, spaced apart from said retracted position in said transverse direction toward said near side, whereby movement of each of said first aligner and said second aligner from said retracted position to said forward position urges said product toward a midpoint between said near side and said far side.

2. The conveyor of claim 1 wherein each of said first aligner and said second aligner comprises an aligner bar which extends into said gap, whereby each said endless belt contacts said bar and moves said first aligner or said second aligner from said retracted position to said forward position, thereby centering said product in said pocket.

3. The conveyor of claim 1 wherein said endless belts are closer to each other at their downstream ends than at their upstream ends.

4. The conveyor of claim 1 wherein said endless belt is driven by said pocket assembly.

5. The conveyor of claim 1 wherein there is a plurality of said pockets.

* * * * *